US007343844B2

(12) United States Patent
Poff, Jr.

(10) Patent No.: US 7,343,844 B2
(45) Date of Patent: Mar. 18, 2008

(54) FIREARM RECOIL ABSORBING SYSTEM

(76) Inventor: Charles Poff, Jr., 3113 SE. 8th Pl., Cap Coral, FL (US) 33904

( * ) Notice: Subject to any disclaimer, the term of this patent is extended or adjusted under 35 U.S.C. 154(b) by 330 days.

(21) Appl. No.: 11/226,822

(22) Filed: Sep. 14, 2005

(65) Prior Publication Data

US 2007/0234897 A1 Oct. 11, 2007

Related U.S. Application Data

(60) Provisional application No. 60/609,946, filed on Sep. 15, 2004.

(51) Int. Cl.
*F41A 3/94* (2006.01)

(52) U.S. Cl. ..... 89/198; 89/44.01; 89/191.01

(58) Field of Classification Search ..... 89/191.01, 89/193, 198, 44.01
See application file for complete search history.

(56) References Cited

U.S. PATENT DOCUMENTS

| | | | | |
|---|---|---|---|---|
| 3,650,177 | A * | 3/1972 | Hupp et al. | 89/130 |
| 3,977,296 | A * | 8/1976 | Silsby et al. | 89/198 |
| 4,503,632 | A | 3/1985 | Cuevas | |
| 4,833,808 | A | 5/1989 | Strahan | |
| 5,353,681 | A | 10/1994 | Sugg | |
| 6,526,686 | B1 | 3/2003 | Poff | |
| 7,131,367 | B1 * | 11/2006 | Boerschig et al. | 89/198 |

* cited by examiner

*Primary Examiner*—Stephen M Johnson
(74) *Attorney, Agent, or Firm*—Mark D. Bowen, Esq.; Stearns Weaver Miller Weissler Alhadeff & Sitterson P.A.

(57) ABSTRACT

An anti-recoil system for counteracting recoil in firearms and weapons using a gas actuated piston assembly is disclosed. A recoil piston is acted upon by gas pressure routed from the receiver/barrel. High pressure gas causes forward movement of the recoil piston thereby generating a force opposing the recoil generated upon firing. A shock absorbing bumper connected to the piston engages the weapon's rearwardly moving bolt assembly. The bolt assembly forces the recoil piston rearward and compresses the bumper and expanded gas in the recoil piston chamber thereby absorbing additional recoil forces. Upon reaching a rear most position a gas relief valve is opened allowing venting of the compressed gases at which point the bolt operating main spring propels the bolt assembly forward, stripping the top round out of the ammunition magazine, loading the next round, locking the bolt and freeing the firing pin to fire the next round. An electrical generation system designed to meet the current and future needs for individual combatants utilizes hereto fore wasted energies produced in the firing of a modern weapon. Specifically it is designed to convert the wasted energy contained in the ejected high pressure gasses and the subsequent recoil produced by the gasses accelerating a projectile to high velocities, and the energy contained in the rapidly moving bolt assembly. This energy is capable of being stored within the weapon, or in external, individual battery packs.

8 Claims, 6 Drawing Sheets

FIRING CYCLE

REAR ASSEMBLY OPERATING SEQUENCES

READY TO FIRE POSITION

FIRING CYCLE

RECOIL ABATEMENT AND ELECTRICAL GENERATION CYCLE

RECOIL RETURN CYCLE

FIREARM RECOIL ABSORBING SYSTEM

CROSS REFERENCE TO RELATED APPLICATIONS

This application claims the benefit of provisional U.S. Patent Application Ser. No. 60/609,946 filed Sep. 15, 2004.

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights rights whatsoever.

BACKGROUND OF THE INVENTION

1. Field of the Invention

The present invention relates to firearms, and more particularly, to a recoil reducing and electrical generation system for large caliber, shoulder-fired weapons.

2. Description of Related Art

Problems relating to recoil when a firearm is discharged have been present in the art for centuries. Recoil results from forces generated by the gases that propel the projectile, or bullet, out of a weapon's barrel. With relatively low power firearms, it is obvious that the recoil is a minimal problem, especially when the firearm itself is quite heavy so the mass of the firearm absorbs a great part of the energy of the recoil. As firearms become more powerful and lighter in weight relative to their power, the recoil becomes an increasing problem.

Large caliber weapons produce significant recoil upon firing such that firing such a weapon directly from the shoulder poses a significant risk of recoil-induced injury to the shooter. The recoil force experienced by the shooter of a conventional weapon is a product of the acceleration of the projectile by these gases and the amount of time that the recoil impulse is experienced by the shooter. In a conventional weapon this amount of time is approximately the time that elapses while the gases are expanding out of the barrel, i.e. the time necessary for the projectile to leave the open end of the barrel. Accordingly, there exists a need for a system that reduces recoil in firearms and weapons.

In addition, the users of firearms and weapons are often simultaneous users of various man portable electrically powered devices. Among these electrically powered devices are night vision equipment, communication equipment, navigational equipment, etc. Each of theses electrically powered devices requires a power source, such as a battery pack. If use of these devices is relied upon heavily, the user is forced to carry replacement battery power sources and/or periodically recharge. Requiring the user to carry non-rechargeable replacement batteries is burdensome. In addition, requiring the user to effectively find a recharging facility, stop, and recharge is equally undesirable.

The present inventor has contributed to advancements in this field, as exemplified by U.S. Pat. No. 6,526,686, issued to Poff et al., wherein an electric charging system for a firearm is disclosed. In that patent I, discloses a port in operable communication with a chamber adapted to receive an amount of expanding gas created by an ignited charge, and a cavity in operable communication with the port and adapted to receive an amount of the expanding gas therefrom. The charging system also includes a charging assembly in operable communication with the cavity, wherein the charging assembly creates an electric charge when impinged by the expanding gas located within the cavity, and a conductor in electrical communication with the charging assembly, wherein the conductor receives the electrical charge from the charging assembly. The charging system further includes a power storage unit in electrical communication with the conductor, wherein the storage unit stores the electrical charge received from the conductor. While this system is considered useful in generating an electrical charge, it has not been fully integrated with a recoil reducing system.

Accordingly, there remains a need for a system that reduces recoil in firearms and weapons and converts this reclaimed energy into useful electrical energy to replace costly and bulky one time use batteries to power current and planned military hardware.

BRIEF SUMMARY OF THE INVENTION

This invention overcomes limitations in the art of firearm recoil reduction by providing an anti-recoil system for counteracting firearm recoil using a gas actuated piston assembly disposed in proximity to the rearward end of the barrel and the receiver housing. The present invention provides, in a firearm, a recoil piston or the like that is acted upon by gas pressure routed to the piston/cylinder from the barrel. In the ready to fire configuration, the recoil piston is biased to a rearward position by a spring. Upon firing, high pressure gas is routed through a channel to act on the recoil piston. The gas causes the recoil piston to move forwardly thereby generating a force opposing the normal forces generated upon firing the weapon. The recoil piston includes a shock absorbing bumper that engages the weapon's rearwardly moving bolt assembly thereby absorbing some of the bolt assembly's energy. The rearwardly vectored momentum of the bolt assembly overcomes the forwardly vectored momentum of the recoil piston thus causing the recoil piston to move rearwardly. The bolt assembly forces the recoil piston rearward and compresses the bumper and the expanded gas in the recoil piston chamber thereby absorbing additional recoil forces. As the bolt assembly completes its rearward travel, it substantially compresses the operating main spring, the bumper, and the gas in the recoil piston chamber. When the bolt assembly reaches a certain rearward position a gas relief valve is opened allowing venting of the compressed gases at which point the operating main spring propels the bolt assembly forward, stripping the top round out of the ammunition magazine, loading the next round, locking the bolt and freeing the firing pin to fire the next round.

This stored energy is transmitted by physical contact to a stack of piezoelectric crystals located between the fixed recoil piston housing and the movable main spring base. This pressure applied to the piezoelectric crystals produces a high voltage pulse of energy for each compression and relaxing cycle. Simultaneous to this power generation, the high pressure gases rounded to the recoil piston are also ported to a much larger stack of piezoelectric crystals located at the rear of the recoil piston housing.

Accordingly, it is an object of the present invention to reduce recoil in firearms and weapons.

Another object of the present invention is to provide an anti-recoil assembly for use with firearms and weapons.

Still another object of the present invention is to provide an anti-recoil assembly wherein recoil forces are absorbed by a combination of an elastomeric shock absorber and piston compressed gases.

Another object of the present invention is to provide an energy reclamation system to generate useful levels of system integrated electrical power for present and future power demands.

In accordance with these and other objects, which will become apparent hereinafter, the instant invention will now be described with particular reference to the accompanying drawings.

BRIEF DESCRIPTION OF THE SEVERAL VIEWS OF THE DRAWINGS

These and other features and advantages of the present invention will become apparent from consideration of the following specification when taken in conjunction with the accompanying drawings wherein.

DETAILED DESCRIPTION OF THE INVENTION

Figure 1:
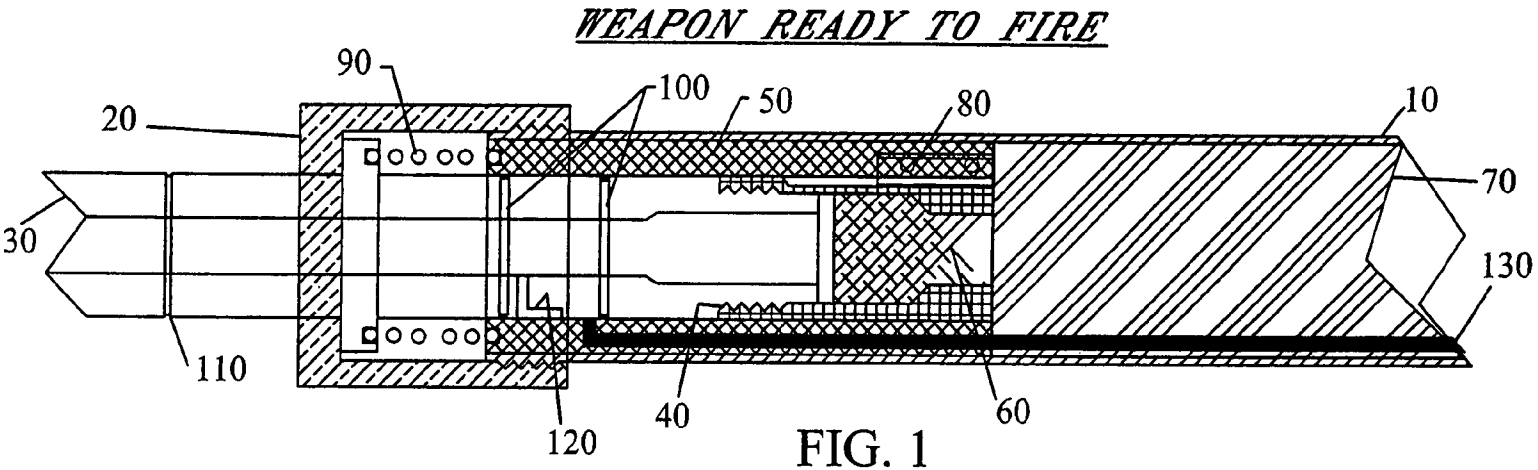
FIG. 1 is a side sectional view of a barrel and bolt assembly for a firearm or weapon.

The present invention provides a recoil reducing system for a firearm or weapon that utilizes excess energy in the propelling gases to produce a counter or opposing force. The opposing force reduces recoil to a level that allows for reliable functioning of the weapon and a safe level of recoil for the weapon operator. In addition, the firing of the weapon will generate electrical power that eliminates the need for costly and heavy non-rechargeable (i.e. single use) batteries required for sighting, communications, and identification systems currently in use by military forces. The preferred embodiment is a short recoil operating system with a self-generating firing cycle that is readily adaptable to all known operating systems.

Barrel and Bolt Assembly

With reference initially to FIGS. 1-4, a firearm or weapon is preferably adapted with an anti-recoil system by modifications to the barrel and receiver sections as disclosed herein. The firearm includes a receiver outer housing 10 having a retaining nut 20 threadably engaged therewith for securing the barrel 30 thereto. An elongated barrel extension 40 is dimensioned to be a sliding fit in a barrel extension housing 50 that is fixed relative to receiver outer housing 10. Barrel extension 40 is adapted to accept the bolt 60 and locking lugs forming an open end of the chamber, and a bolt carrier 70 is disposed within receiver outer housing 10. Barrel extension 40 has one or more longitudinal channels defined in the outer surface thereof to provide seats for mating with guide ribs 80 to allow quick removal of the barrel assembly for portability and maintenance, while allowing for and providing precise alignment and torque control insuring accurate placement of shots. A return spring 90 functions to return the barrel to a forward, ready-to-fire position. In addition, barrel 30 has two, appropriately spaced circumferential channels that provide seats for high pressure sealing O-rings 100. Barrel 30 further includes a lock ring barrel retaining nut 110.

Barrel 30 is adapted with an appropriately dimensioned gas porting thru bore 120, disposed between the barrel sealing O-rings 100, to allow the correct amount and pressure of gases to be channeled to the anti-recoil assembly disclosed herein. The gas porting thru bore 120 includes a longitudinal channel that extends from the radial portion of thru bore 120 toward the rear end of the barrel assembly. The purpose of the longitudinal channel is to allow the passage of high-pressure gases to be channeled into the recoil reducing system, via gas transfer tube 130 defined in barrel extension housing 50 and bolt carrier 70, while the barrel and bolt assemblies are locked together and are in the recoil stage operation.

Barrel and Bolt Assembly Operating Sequences

FIG. 1 depicts the barrel and bolt assembly in a ready-to-fire mode wherein the weapon is loaded, locked, and ready to fire. In this configuration barrel 30 is in the forward position and the gas ports are closed. More particularly, the barrel gas porting thru bore 120 is not in fluid communication with gas transfer tube 130.

Figure 2:
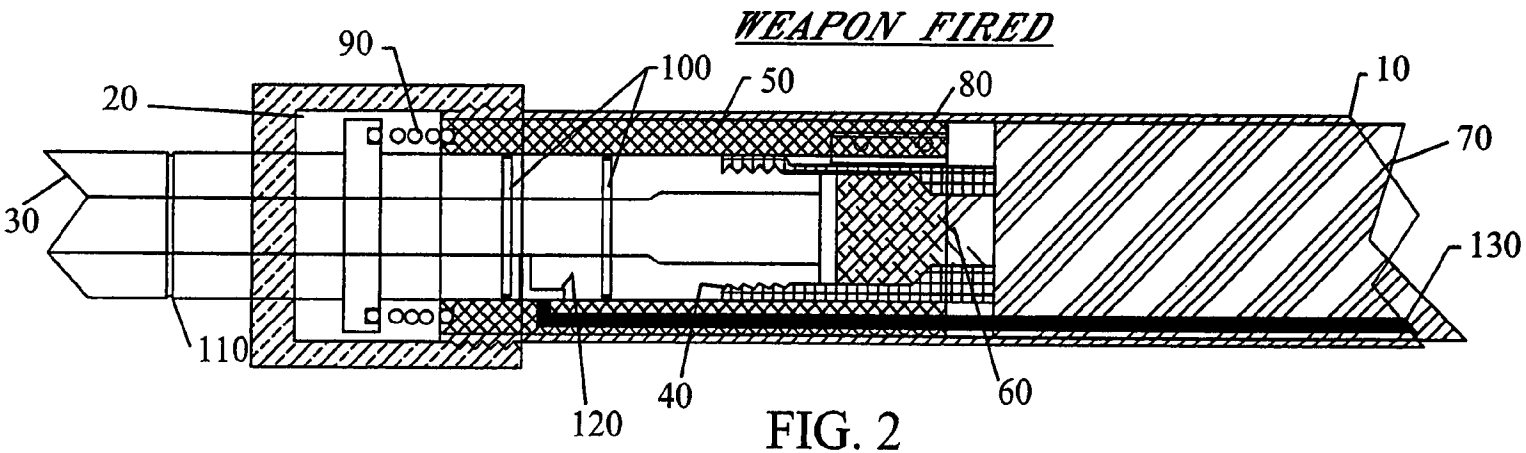
FIG. 2 is a side sectional view thereof illustrating a firing sequence.

FIG. 2 depicts the barrel and bolt assembly in a firing mode wherein barrel 30, barrel extension 40, bolt 60 and, bolt carrier 70, are locked together and accelerating rearward. As illustrated in FIG. 2, the gas ports are open and gases are ported to the rear for actuating the recoil absorbing system and electrical generation system. Specifically, the barrel gas porting thru bore 120 is in fluid communication with gas transfer tube 130.

Figure 3:
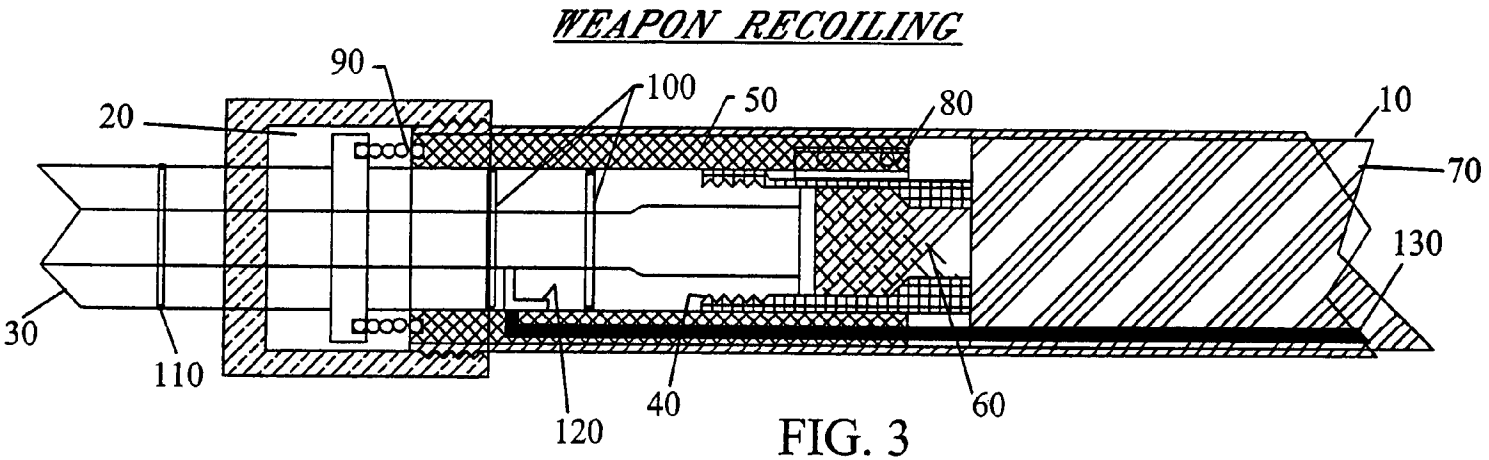
FIG. 3 is a side sectional view thereof illustrating a recoil sequence.

FIG. 3 depicts the barrel and bolt assembly in a recoiling mode wherein the barrel and bolt assemblies have reached a rearward unlocking position. As depicted in FIG. 3, the gas ports remain open and gases are ported to the rear for actuating the recoil absorbing system. Specifically, the barrel gas porting thru bore 120 remains in fluid communication with gas transfer tube 130. The gas transfer tube 130 has, at its connection point with the high pressure gas channel 290, a one-way valve that will admit gas to enter the high pressure gas channel.

Figure 4:
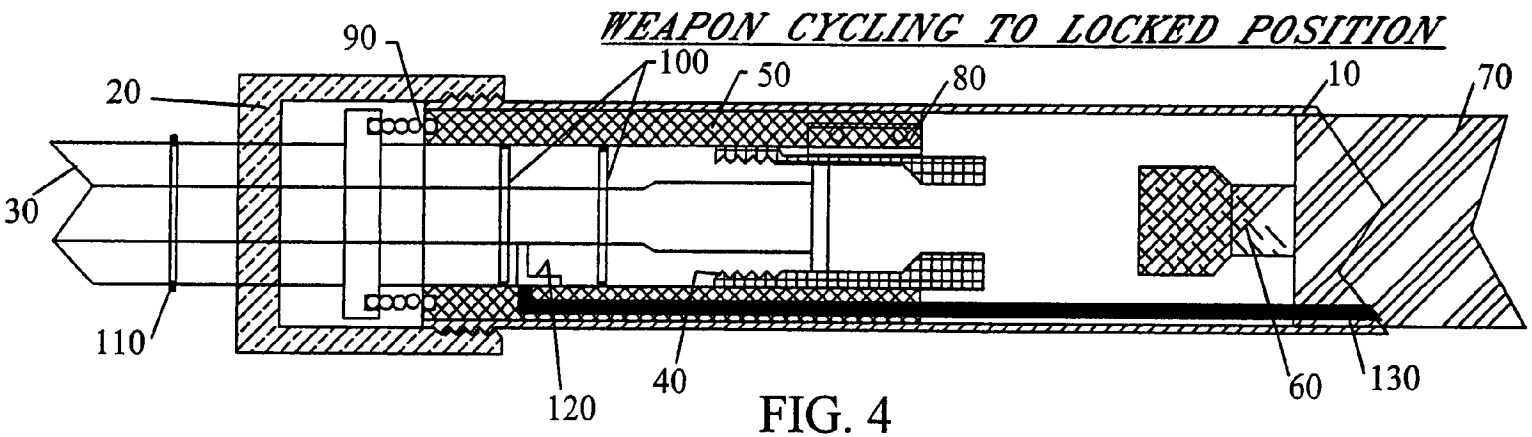
FIG. 4 is a side sectional view thereof illustrating the weapon cycling to locked position.

FIG. 4 depicts the barrel and bolt assembly at a rearward position wherein the bolt assembly contacts the anti-recoil assembly discussed more fully below. The barrel and barrel extension are returned to the forward/firing position by the barrel return spring 125. An operating spring returns the bolt assembly to a forward position stripping the top round from the magazine, cocking the firing pin, and chambering the next round.

Recoil Abatement Assembly

Figure 5:
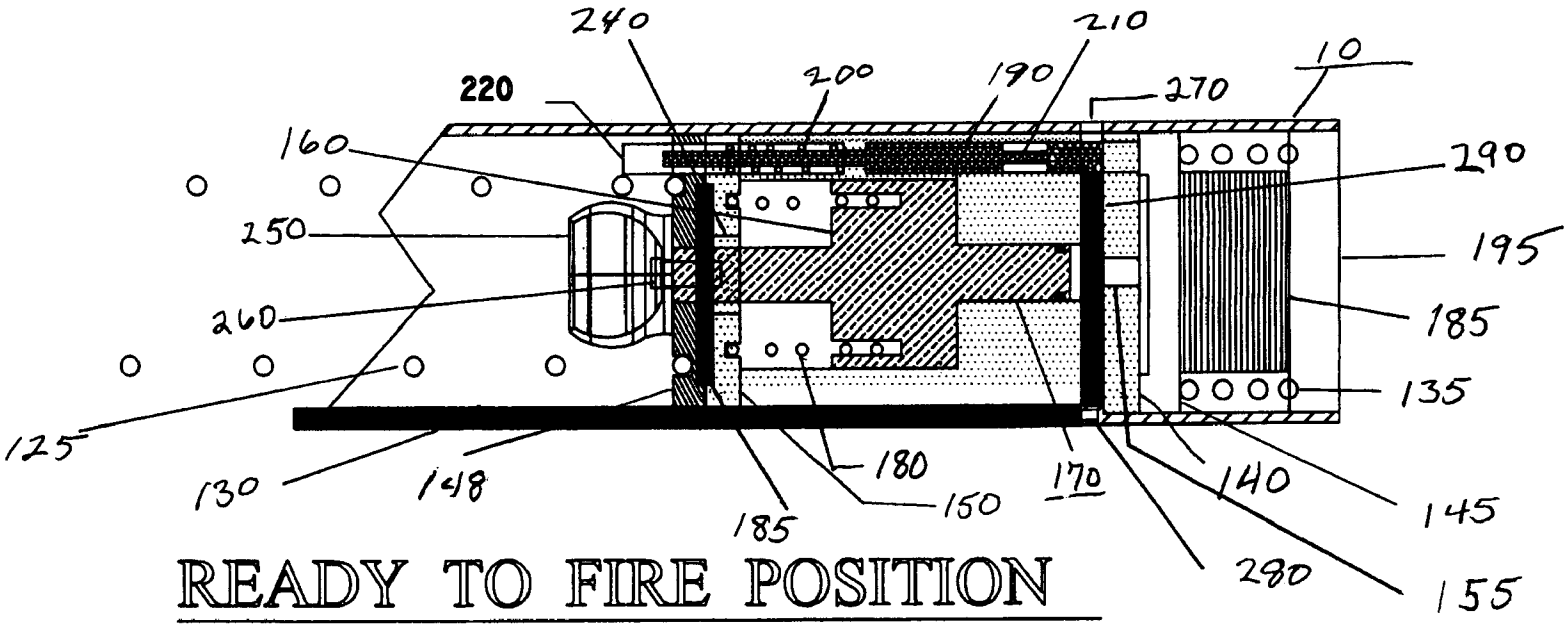
FIG. 5 is a side sectional view of an anti-recoil and electrical power generation sub-systems assembly in accordance with a preferred embodiment of the present invention in a ready to fire configuration.

Referring now to FIGS. 5-8 there is depicted a firearm receiver housing adapted with a preferred embodiment of an anti-recoil system for firearms and weapons. The anti-recoil system is contained within receiver outer housing 10 and includes an anti-recoil housing 140 having a housing end plate 150 which cooperate to define an internal volume. As best depicted in FIG. 5, anti-recoil housing 140 is adapted to receive a recoil piston 160 received within a cylinder 170. Cylinder 170 and recoil piston 160 function as an expansion chamber for high pressure gas as discussed herein below. Piston 160 preferably includes sealing O-rings, referenced as 160A, for maintaining a pressure resistant seal between piston 160 and the surrounding cylinder wall. The anti-recoil assembly further includes a piston return spring 180 that functions to bias piston 160 to a rearward, ready-to-fire position as depicted in FIG. 5. An elastomeric shock absorber 250 is fixed to recoil piston 160 by bolt 260 as best seen in FIG. 5. Elastomeric shock absorber 250 functions to absorb momentum from the rearward traveling bolt assembly as more fully described herein below. The forward end of recoil piston 160 is supported by bearing 204 in end plate 150.

Figure 8:
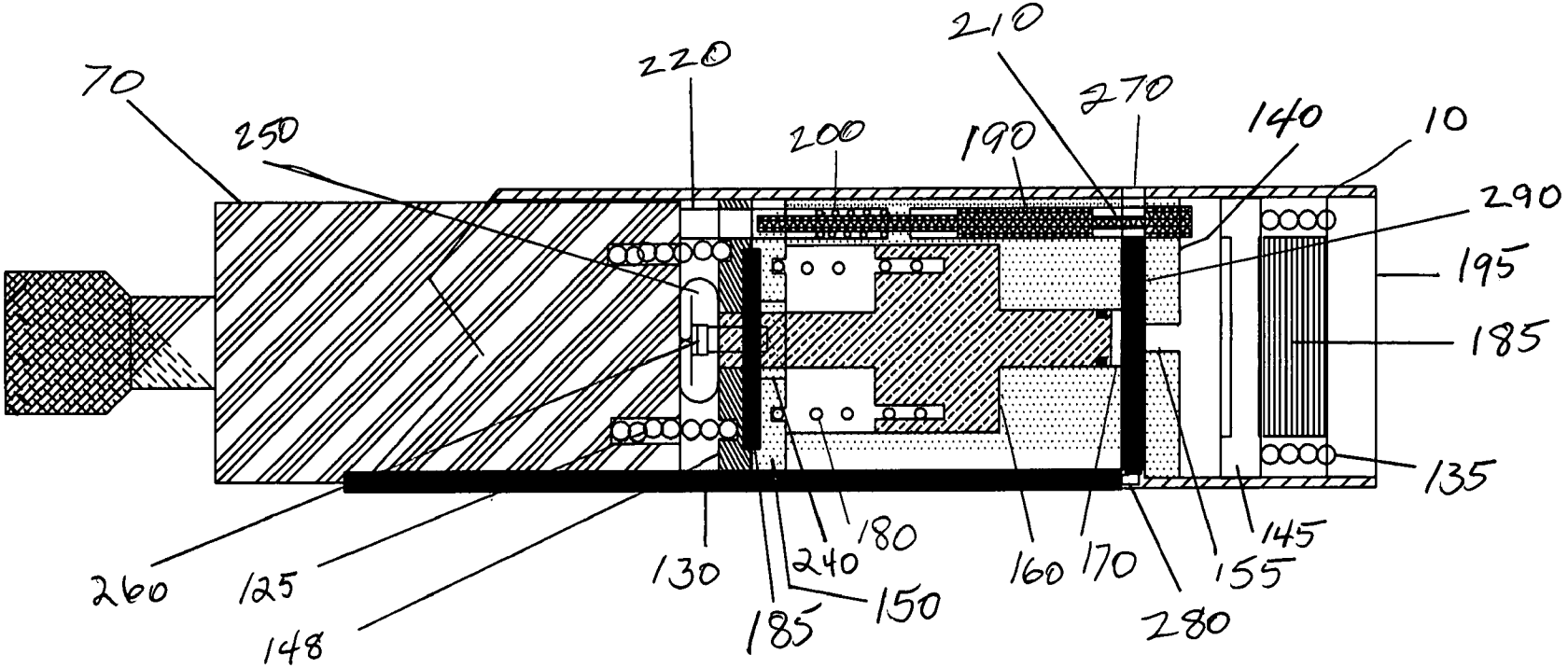
FIG. 8 is a side sectional view thereof illustrating the assembly at a subsequent stage of the firing cycle wherein the bolt assembly has reached the full extent of its rearward travel whereby the forward and rearward electrical generators have achieved peak voltage generation and the output is appropriately conducted to either an on-board or external power rectifying and storage system.

A high-pressure gas channel 290 has an inlet in communication gas transfer tube 130 depicted in FIGS. 1-4. Gas channel 290 includes a mid portion in communication with cylinder expansion chamber 170 and recoil piston 160, and a high pressure gas port 155, to gas pressure chamber formed by rear high pressure gas transfer plate, and an outlet in selective communication with a receiver gas vent hole 270. A pressure relief mechanism is incorporated to selectively relieve pressure acting on piston 160 when the bolt assembly has reached a rearward most position as depicted in FIG. 8. More particularly, the anti-recoil assembly includes a pressure relief piston body 190 biased forwardly in the ready-to-fire mode by a piston return spring 200 such that the rearward end portion of piston body 190 blocks fluid communication between high pressure gas channel 290 and vent hole 270 as depicted in FIG. 5. Pressure relief piston body 190 defines a gas-venting aperture 210 disposed at an intermediate location thereon. Pressure relief piston 190 is normally disposed in a configuration depicted in FIGS. 5-7 wherein chamber gases are prevented from traveling down a high pressure gas channel 290 to a receiver vent hole 270 during the ready-to-fire and shortly after firing stages. Pressure relief piston 190 is moved to a venting configuration depicted in FIG. 8 wherein chamber gases are allowed to vent from receiver vent hole 270 thereby relieving pressure from piston 160. This release of pressure allows the recoil piston 160 to return to its rearmost position and rear generator pressure plate 145 to return to its foremost position by pressure applied by spring 135. Both movements remove pressure on the piezoelectric generators 185, thus creating a second additional pulse of electrical energy. Pressure relief piston 190 is received within retaining cap 220 having an end portion thereof projecting into the receiver chamber. As best depicted in FIG. 4, the bolt assembly engages retaining cap 220 at its rearward most position thereby causing pressure relief piston to move to the venting configuration depicted in FIG. 8. Piston return spring 200 functions to return the pressure relief piston 190 to the ready-to-fire position upon completion of the firing process.

Recoil Abatement Assembly Operating Sequences

The structure disclosed herein above reduces recoil using a recoil piston or the like that is acted upon by gas pressure routed to the piston/cylinder from the barrel. FIGS. 1 and 5 respectively depict the barrel and bolt assembly and the anti-recoil assembly in the ready-to-fire configuration, wherein recoil piston 160 is biased to a rearward position within the anti-recoil assembly housing 140 by recoil piston return spring 180. In this configuration piston 160 is in fluid communication with the barrel gas port via high pressure channel 290, while gas is prevented from venting through gas vent hole 270 by an end portion of pressure relief piston body 190 which is maintained in a forward most position by spring 200.

FIG. 2 depicts the anti-recoil assembly at the initial stages of a firing cycle wherein propellant gas has begun propelling a round down the barrel. During this stage, high pressure gas is routed gas channels 120, 130, 280 and 290 so as to be in fluid communication with recoil piston 160. Pressure is maintained in high pressure channel 290 since the end portion of pressure relief piston 190 blocks communication of high pressure channel 290 with vent hole 270. Accordingly, high pressure gas causes recoil piston 160 to move forward, as depicted in FIG. 6, thereby generating a force opposing the normal forces generated upon firing the weapon.

Figure 6:
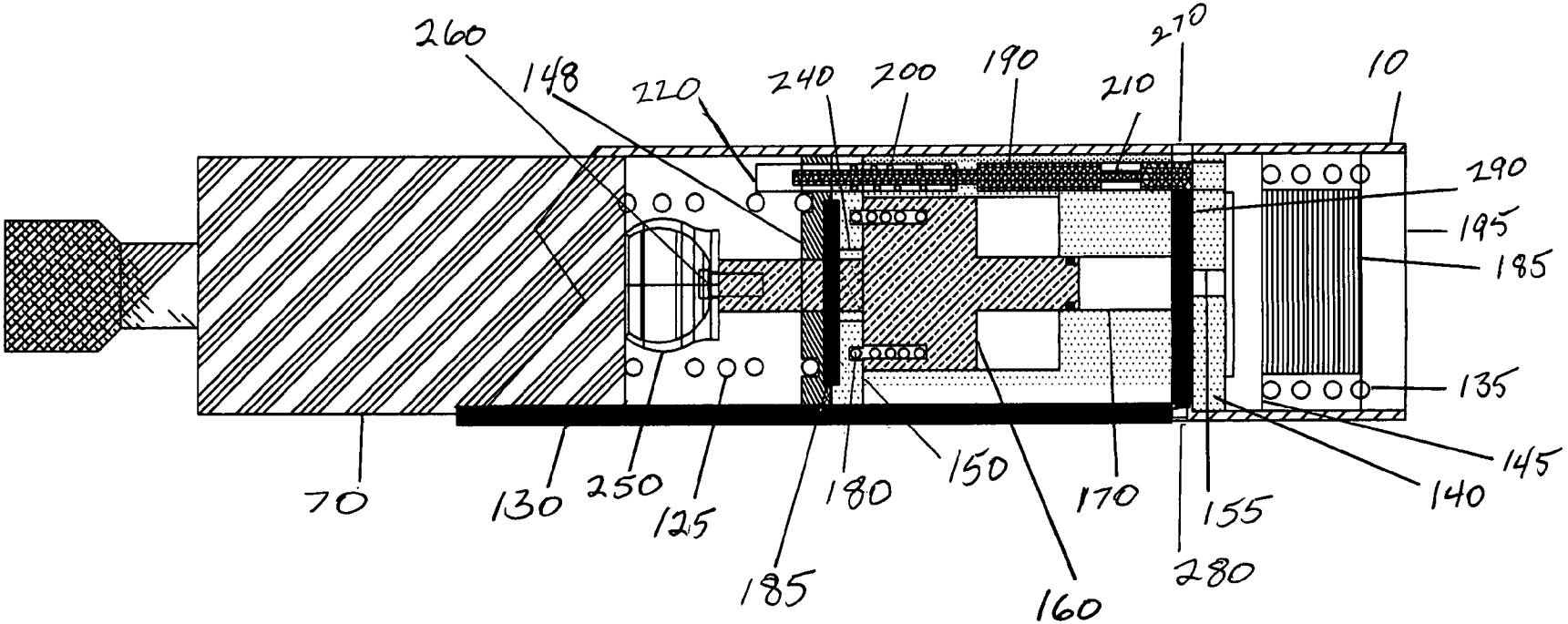
FIG. 6 is a side sectional view thereof illustrating the assembly at an initial stage of the firing cycle wherein the bolt assembly is moving rearward and high pressure gas has started to compress the main/rear piezoelectric crystal stack generating electricity.
Figure 7:
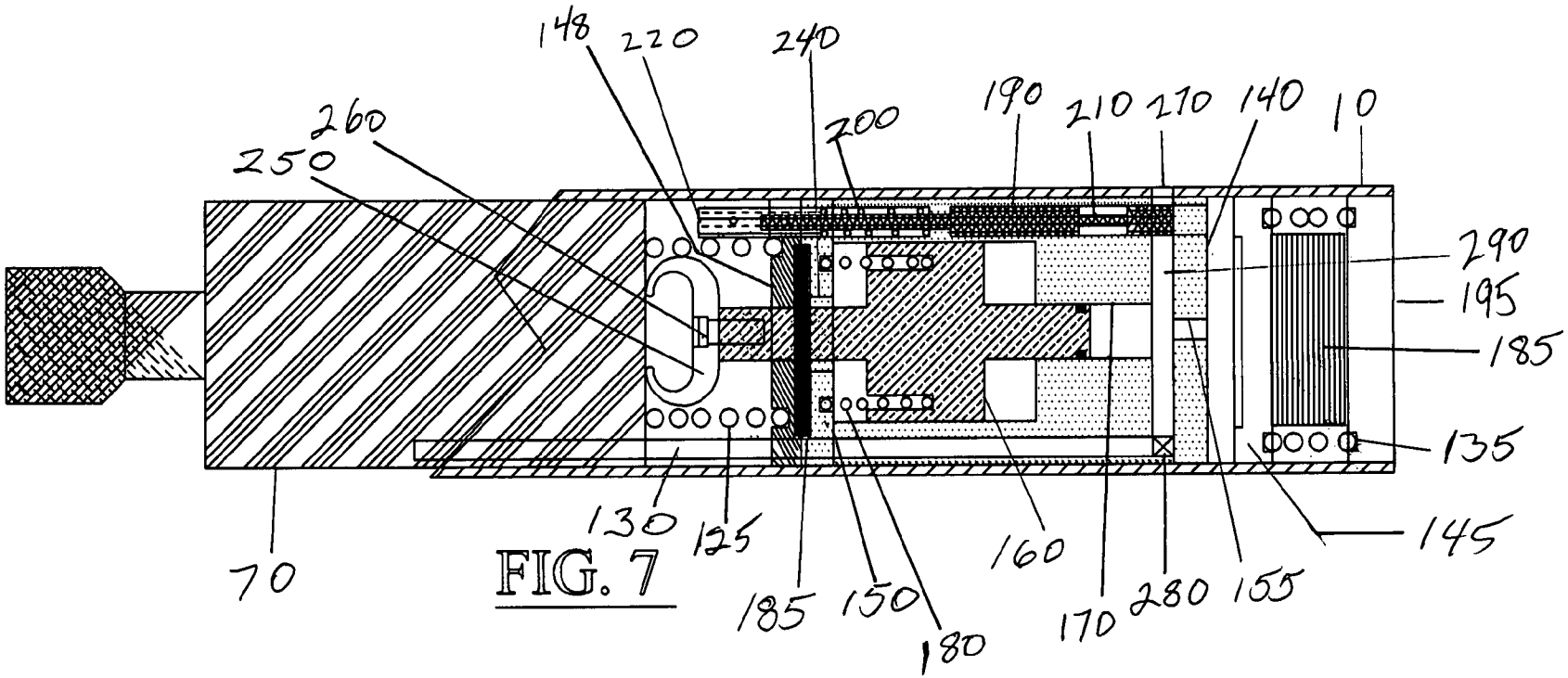
FIG. 7 is a side sectional view thereof illustrating the assembly at a subsequent stage of the firing cycle wherein the rearwardly moving bolt assembly engages the anti-recoil assembly.

As best depicted in FIG. 6, recoil piston 160, and more particularly elastomeric shock absorber 250 engages the weapon's rearwardly moving bolt assembly thereby absorbing some of the bolt assembly's energy. The rearwardly vectored momentum of the bolt assembly overcomes the forwardly vectored momentum of recoil piston 160 thus causing the recoil piston to move rearwardly while compressing elastomeric shock absorber 250. Accordingly, as best depicted in FIG. 8, the bolt assembly compresses elastomeric shock absorber 250 while forcing recoil piston 160 rearward and compressing the gas in recoil piston chamber 170 thereby absorbing additional recoil forces. FIG. 8 depicts the operating sequence wherein the bolt assembly completes its rearward travel, having substantially compressed elastomeric shock absorber 250 while returning piston 160 to a reawardly most position thereby compressing the gas. During this phase of the operating sequence, namely when the bolt assembly reaches a predetermined rearward position the bolt assembly engages retaining cap 220 thereby causing pressure relief piston 190 to move to the venting configuration depicted in FIG. 8 wherein chamber gas is allowed to vent from receiver vent hole 270 by passing through gas venting channel 210 in pressure relief piston body 190. With the venting of gas through vent hole 270, pressure is relieved from piston 160 whereafter recoil piston return spring 180 returns recoil piston to its rearward, ready-to-fire configuration seen in FIG. 5. At about the same time, the bolt operating main spring propels the bolt assembly forward, stripping the top round out of the ammunition magazine, loading the next round, locking the bolt and freeing the firing pin to fire the next round.

Electrical Energy Generation Operating Sequences

The structure disclosed herein utilizes the normally wasted energy generated in the firing of a modern weapon as contained in weapon recoil and high pressure and volume of propellant gases, to generate useful levels of electrical energy as required by current and planned military weaponry and tactics. FIGS. 5, 6, 7 and 8 depict the recoil abatement and electrical generation components and sequences of operation.

FIG. 5 depicts the rear assembly in the ready to fire sequence. The electrical generation components are identified by their part numbers circled. Reading from left to right, part 148 is a movable base/pressure plate supporting on its forward side the operating main spring with a center hole which allows the recoil piston 160 to move forward under gas pressure applied to rear most part of the piston in pressure chamber 170. The rear side of pressure plate 148 has a cavity that supports the front face of a stack of piezoelectric crystals 185. The forward face of recoil absorbing housing 150 contains a circular cavity that supports the rear face of the piezoelectric crystals 185. The two plates 148 and 150 form a cavity that when in contact with each other for a central cavity that will be approximately 0.010 shorter in length than the crystal stack, insuring all forces applied to movable pressure plate by the compressing operating spring 125, and the forces applied to the bumper 250 by the rearward movement of the bolt assembly 70 are applied to the forward crystal stack 185. High pressure gasses ported to recoil abatement piston housing 140 thru one way valve 280 into high pressure channel 290 are free to actuate recoil piston 160 and thru gas port 140 expand into the rear chamber containing rear pressure plate 145, crystal stack 185, return spring 135 and end cap 195. This rear generator produces a significantly larger output due to its size and amount of pressure that can be applied by direct high pressure gasses and a longer duration. Both forward and rear generators will use the metal of the receiver 10, as a common ground with the positive side of the crystal stacks being suitably hardened and insulated to withstand typical usage of this type of weapon system. The electronic circuitry required to collect, filter, rectify and provide output via currently standardized hardened military electronic connectors can be provided as a weapon attaché external or internal module or either means as required. Additionally the weapon does not need to be fired to generate electricity as operating the weapon's bolt manually will generate a significant amount of electrical power.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A firearm recoil abatement system for reducing recoil forces resulting from the firing of a projectile from the barrel of a firearm, said recoil reducing system comprising:

a firearm having a barrel and bolt assembly for containing high-pressure gas upon firing, said barrel and bolt assembly including a bolt having a rearward end, said barrel and bolt assembly slidably movable between forward and rearward positions;

a gas-actuated piston disposed within a housing in proximity to said rearward end of said bolt and generally longitudinally aligned therewith;

said piston having a resilient bumper connected to the forward end thereof;

said piston biased to a rearward position by a spring in a ready to fire configuration wherein said resilient bumper is spaced from said rearward end of said bolt;

said piston in fluid communication with said barrel when said barrel and bolt assembly is disposed proximal said rearward position such that high pressure gas generated by the firing of said firearm forces said piston forward toward said bolt and forces said bolt rearward toward said piston and into engagement with said resilient bumper;

whereby said resilient bumper engages said bolt and reduces the momentum of said bolt.

2. A firearm recoil abatement system according to claim 1, further including a normally closed gas relief valve configurable to an open configuration when said bolt substantially reaches said rearward position.

3. A firearm recoil abatement system according to claim 1, further including means for generating electrical energy for use in powering electrical apparatus.

4. A firearm recoil abatement system according to claim 3, wherein said means for generating electrical energy includes piezoelectric material.

5. A firearm recoil reducing system for reducing recoil forces resulting from the firing of a projectile from the barrel of a firearm, said recoil reducing system comprising:

a firearm having a barrel and bolt assembly for containing high-pressure gas upon firing, said barrel and bolt assembly including a bolt having a rearward end, said bolt slidably movable between forward and rearward positions;

a gas-actuated piston disposed within a housing in proximity to said rearward end of said bolt and generally longitudinally aligned therewith, said piston slidably movable between forward and rearward positions;

said piston assembly having a resilient bumper connected to the forward end thereof;

means for biasing said piston to said rearward position by a spring in a ready to fire configuration wherein said bolt is in said forward position with said resilient bumper spaced from said rearward end of said bolt;

said piston assembly further including an expansion chamber in fluid communication with said barrel such that high-pressure gas generated by the firing of said firearm urges said piston forward toward said bolt, and urges said bolt rearward toward said piston, whereby said bolt rearward end engages said piston resilient bumper and reduces the momentum of said bolt;

said expansion chamber including a normally closed gas relief valve configurable to an open position wherein gas is vented from said chamber to the atmosphere;

said valve actuated to said open configuration when said bolt substantially reaches said rearward position.

6. A firearm recoil abatement system according to claim 5, further including means for generating electrical energy for use in powering electrical apparatus.

7. A firearm recoil abatement system according to claim 6, wherein said means for generating electrical energy includes piezoelectric material.

8. A firearm recoil abatement system according to claim 6, wherein said means for generating electrical energy may be activated by manual operation of said bolt.

* * * * *